US009010891B2

(12) United States Patent
Roof et al.

(10) Patent No.: US 9,010,891 B2
(45) Date of Patent: Apr. 21, 2015

(54) SYSTEMS AND METHODS FOR IN-LINE GEL INK MIXING

(75) Inventors: Bryan J. Roof, Newark, NY (US); James Larson, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 152 days.

(21) Appl. No.: 13/464,351

(22) Filed: May 4, 2012

(65) Prior Publication Data

US 2013/0293603 A1 Nov. 7, 2013

(51) Int. Cl.

| | |
|---|---|
| ***B41J 29/38*** | (2006.01) |
| ***B41J 2/21*** | (2006.01) |
| ***B41J 2/175*** | (2006.01) |
| ***B41J 2/195*** | (2006.01) |

(52) U.S. Cl.

CPC *B41J 2/211* (2013.01); *B41J 2/175* (2013.01); *B41J 2/17596* (2013.01); *B41J 2/195* (2013.01)

(58) Field of Classification Search

USPC ..... 347/6

See application file for complete search history.

(56) References Cited

U.S. PATENT DOCUMENTS

| | | | | |
|---|---|---|---|---|
| 4,121,222 | A * | 10/1978 | Diebold et al. | 347/7 |
| 5,142,306 | A * | 8/1992 | Arahara et al. | 346/140.1 |
| 5,531,817 | A * | 7/1996 | Shields et al. | 106/31.38 |
| 6,454,402 | B1 * | 9/2002 | Koitabashi et al. | 347/100 |
| 6,631,983 | B2 * | 10/2003 | Romano et al. | 347/89 |
| 6,679,597 | B2 * | 1/2004 | Ohsawa et al. | 347/95 |
| 7,072,596 | B2 * | 7/2006 | Smith et al. | 399/45 |
| 7,323,063 | B2 * | 1/2008 | Okubo et al. | 118/690 |
| 8,282,197 | B2 * | 10/2012 | De Voeght et al. | 347/85 |
| 2011/0109712 | A1 * | 5/2011 | Grant et al. | 347/105 |

FOREIGN PATENT DOCUMENTS

| | | | | |
|---|---|---|---|---|
| WO | WO 2006111707 | A1 * | 10/2006 | B41J 11/00 |

* cited by examiner

*Primary Examiner* — Jannelle M. Lebron
*Assistant Examiner* — Jeremy Bishop
(74) *Attorney, Agent, or Firm* — Ronald E. Prass, Jr.; Prass LLP

(57) ABSTRACT

Systems and methods for controlling ink component concentration for optimizing ink for use on specific media types, such as paper or plastic, include an in-line ink delivery system for mixing and delivering ink. The ink delivery system includes a first ink supply, a second ink supply, a mixing chamber or pot, and a print head connected to a print head reservoir. The ink delivery system may be configured to mix ink according to one of stored setpoints or acquired media data for media on which ink is to be printed.

12 Claims, 6 Drawing Sheets

SYSTEMS AND METHODS FOR IN-LINE GEL INK MIXING

FIELD OF DISCLOSURE

The disclosure relates to systems, methods, and apparatus for in-line mixing of marking material such as gel ink. In particular, the disclosure relates systems and methods for open loop and closed loop control of in-line ink mixing.

BACKGROUND

A particular design or composition of marking material such as ink may depend on printing conditions and media or substrate types(s) to which the marking material is to be applied. For example, concentrations of particular ink components may be varied as needed for particular print jobs for digital direct marking applications using in-line jetted inks.

SUMMARY

It is desirable and advantageous to control selection, addition, and mixing of components of marking materials—gel inks, for example—prior to delivery of said marking materials to a print head. Systems and methods for in-line gel ink mixing control are disclosed.

This disclosure is not limited to the particular systems, devices and methods described. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

In an embodiment, methods may include a method for configuring ink in-line for printing on a specific media type, comprising delivering ink having a selected ink component concentration to a print head, the selected ink component concentration being selected based on the media type. Methods may include the ink component concentration being a gel concentration, the ink delivered to the print head including ink from at least one of a first ink supply and a second ink supply, the first ink supply containing ink having a first gel concentration, and the second ink supply containing ink having a second gel concentration. Methods may include the ink component concentration of the delivered ink being based on an ink content setpoint that is based on at least one of stored setpoint data corresponding to media type and test print image analysis.

In an embodiment, methods may include a method for media-specific ink content control for delivering ink having a selected component concentration to a print head for printing on a specific media type, the method comprising determining whether ink content setpoints for the media type are stored in memory; and acquiring selected media characteristics if setpoints are not stored in memory. Methods may include the determining selected media characteristics comprising determining whether the selected media is porous or non-porous. Methods may include determining whether the selected media is coated or non-coated if media is porous; determining a thickness of the selected media; producing an ink mixture having an ink component content based on the determined media thickness; and printing a test image using ink having the ink component content based on the determined media thickness.

In an embodiment, methods may include the determining selected media characteristics comprising determining whether the selected media is porous or non-porous; determining a surface energy of the selected media if the media is non-porous; producing an ink mixture having an ink component content based on the determined surface energy; and printing a test image using ink having the ink component content based on the determined surface energy. Methods may include recalling the setpoints if the setpoints are stored in memory. In an embodiment, determining whether showthrough of the test print image is acceptable. Methods may include the determining further comprising measuring showthrough using a sensor system. Methods may include printing a test image using at least one of an ink having an increased component concentration or an adjusted print head temperature depending on measurement results.

Methods may include determining whether line width is acceptable; and printing a test print image using an ink having a decreased component concentration if line width is too small, or increased component concentration if line width is too great. Methods may include printing a test image using at least one of an ink having an adjusted component concentration, the adjusted component concentration being the increased concentration or the decreased concentration, or an adjusted print head temperature. In an embodiment, methods may include determining whether a drawback is acceptable; and printing a test print image using an ink having an adjusted component concentration is drawback is not acceptable. When a heated ink droplet is ejected from a print head onto a printable substrate, a width of the droplet on the substrate may decrease—the ink may drawback—as the ink droplet cools due to mismatch in surface energies, for example.

Methods may include running a print job using ink having the component concentration of the ink used to print the test print image if drawback is acceptable. Methods may include storing the component concentration corresponding to the media type as a set point for the media type. Methods may include determining whether line width is acceptable; and printing a test print image using an ink having a decreased component concentration if line width is too small, or increased component concentration if line width is too great. Methods may include printing a test image using at least one of an ink having an adjusted component concentration, the adjusted component concentration being the increased concentration or the decreased concentration, or an adjusted print head temperature. Methods may include determining whether a drawback is acceptable; and printing a test print image using an ink having an adjusted component concentration if drawback is not acceptable. Methods may include running a print job using ink having the component concentration of the ink used to print the test print image if drawback is acceptable.

In an embodiment, apparatus may include a computer readable recording medium having computer readable instructions, comprising determining whether ink content setpoints for a selected media type are stored in memory; acquiring selected media characteristics if setpoints are not stored in memory; delivering ink having a selected gel concentration to a print head, the selected gel concentration being based on the setpoints or the acquired media characteristics.

In an embodiment, systems may include an ink content control system for controlling ink content in accordance with media type, comprising an ink mixing and delivery system configured for delivering ink having a selected ink component concentration to a print head, the ink delivered to the print head being mixed in-line to achieve the selected ink component concentration; at least one controller for determining whether ink content setpoints for a selected media type are stored in memory and acquiring selected media characteristics if setpoints are not stored in memory, the selected ink component concentration being based on the setpoints or the acquired media characteristics.

In an embodiment, methods may include measuring an amount of the first ink component delivered to a mixing pot until a desired amount of the first ink component is contained by the mixing pot; measuring an amount of the second ink component delivered to the mixing pot until a desired amount of the second ink component is contained by the mixing pot; heating and mixing the ink component and the second ink component in the mixing pot to produce a mixed ink having a desired ratio of the first ink component and the second ink component; and delivering the ink to a reservoir connected to the print head. In an embodiment, methods may include the measuring of the first ink component and the measuring the second ink component being performed using a first flow sensor and a second flow sensor. In another embodiment, methods may include the measuring the first ink component comprising weighing the mixing pot to determine a first mixing pot weight; delivering the first ink component to the mixing pot until a desired second mixing pot weight is reached; and delivering the second ink component to the mixing pot until a desired third mixing pot weight is reached.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
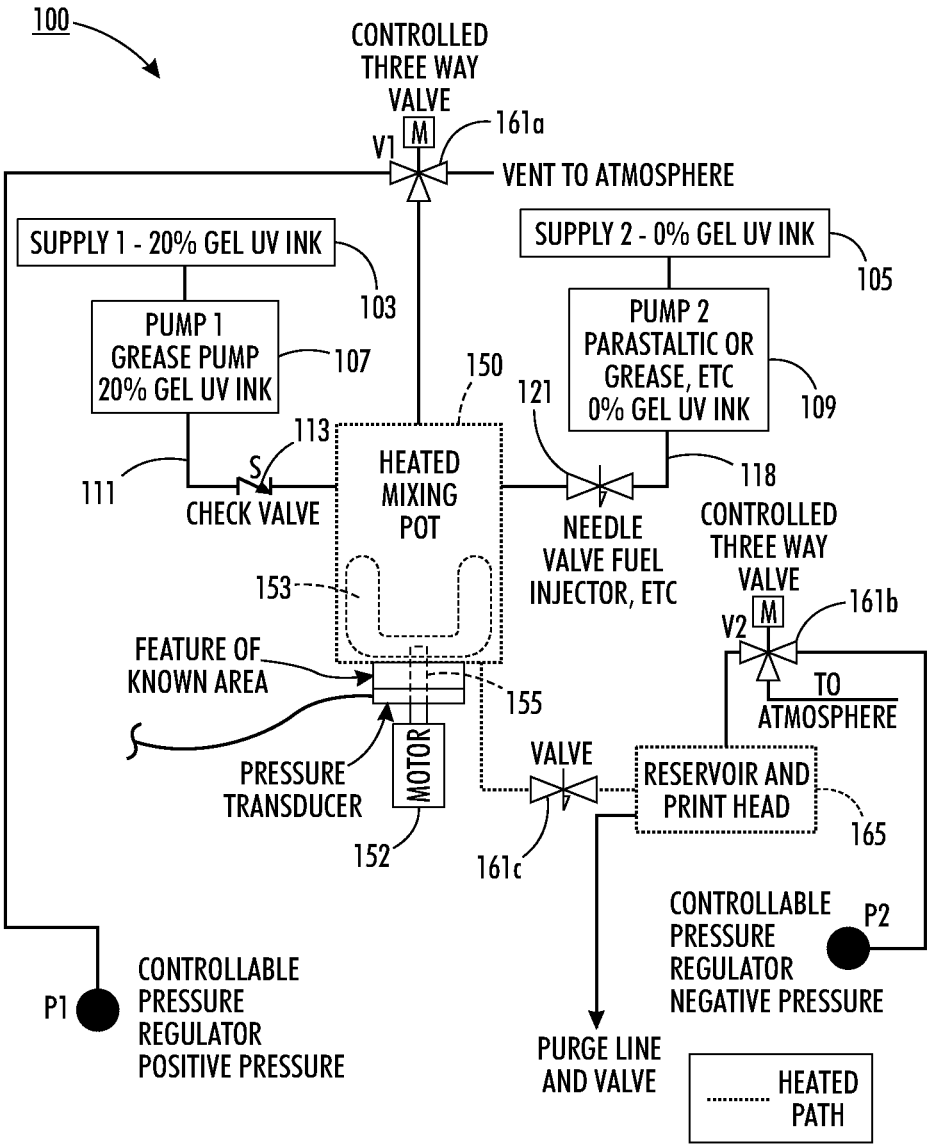
FIG. 1 shows a diagrammatic view of a gel ink mixing system in accordance with an exemplary embodiment.

Exemplary embodiments are intended to cover all alternatives, modifications, and equivalents as may be included within the spirit and scope of the apparatus and systems as described herein.

Reference is made to the drawings to accommodate understanding of systems and methods for in-line ink mixing control. In the drawings, like reference numerals are used throughout to designate similar or identical elements. The drawings depict various embodiments and data related to embodiments of illustrative systems and methods for in-line mixing of marking material such as gel ink.

Methods and systems for in-line mixing of radiation-curable gel inks such as ultraviolet gel inks are disclosed by way of example. Methods and systems may be advantageously configured for mixing of other inks such as heavy latex loaded inks, epoxy-based inks, and linseed oil inks.

In digital direct marking applications using jetted inks, particular ink designs or compositions may be used depending on printing conditions and/or a substrate(s) to which the ink is to be applied. It has been found that one ink design is typically not optimal for all printing conditions. For example, when printing on a substrate such as rough paper, a liquid UV curable ink may be soak into the paper to an extend sufficient to cause showthrough. Showthrough is a term that relates to the ability to seen an image from an opposite side of a substrate onto which ink has been applied. To mitigate showthrough, gel may be added to liquid ink.

In particular, radiation curable ink that includes a gel component tends to thicken, becoming substantially more viscous as a drop of jetted ink contacts a substrate, which is cooler than the typically heated ink. After this quenching action, a substantial change in viscosity, for example, a thickening occurs. An ability to quickly alter a viscosity of the ink provides an ability to interfere with a capillary action of a particular substrate.

Although addition of a gel component enables increased control over ink viscosity, it also causes an increased pile height, or an increased height of an ink drop or line with respect to a surface of a substrate on which the ink is deposited. Because the ink solidifies rapidly upon cooling, a time during which a deposited ink drop or line has to spread out onto a substrate is limited, resulting in undesirable line widths.

A liquid radiation curable ink having relatively high gel content may be suitable for use on porous media such as rough paper. The same ink, however, may not be suitable for use on non-porous media such as plastics, which may exhibit little to no capillary action. As such, the same ink may cause increased objectionable pile heights and/or poor line width when used on non-porous media relative to use on porous media. Such deleterious effects may be compounded by the magnitude of the surface energy of the substrate being printed on. Showthrough is a less prominent issue for non-porous media. Rather, a more substantial concern is whether ink being deposited on the non-porous substrate has enough gel to prevent coalescence of ink drops deposited on the substrate. Accordingly, an amount of gel required to be included in ink to be deposited on non-porous media may be less than that required to be included in ink to be deposited on porous media.

It is desirable to change an amount of gel in UV gel ink depending on a substrate to be printed on, e.g., a particular media type such as porous, or non-porous. Systems and methods accommodate control over marking material components such as a gel concentration in radiation curable ink for printing on media in printing systems.

Systems may be configured for direct marking applications using jetted radiation curable, e.g., UV curable inks. Systems enable in-line mixing of ink and control over ink constituent concentrations. Systems may be configured for mixing an ink having high gel concentration with an ink having a low gel concentration in appropriate ratios to obtain an ink having a desired gel content. To determine an amount of the high gel ink and/or low gel ink being delivered to a mixing pot for obtaining a mixture of a desired concentration, a flow meter system may be used. A flow meter may be implemented in each supply line. The ink supply may be heated to maintain a viscosity that is compatible for effective use of implemented flow meters. The ink should be past a phase transition state of the gel component so that a variety of flow meter architectures may be operably implemented. Alternatively, mass measurement methods of ink component addition may be implemented as disclosed. For flow measurement, a known ink density and known flow meter area may be used to determine an amount of mass that passes through a meter. The supply may be pressurized, and pressure control may be implemented as required in conjunction with ink mixing methods.

While in-line mixing of gel inks using systems that enable in-line mixing of ink and control over ink constituent concentrations are discussed by way of example, delivery of other marking materials may be similarly controlled for enhanced print quality and substrate or media range.

FIG. 1 shows a diagrammatic view of an exemplary in-line gel ink mixing system. In particular, FIG. 1 shows a system 100 having a first ink supply 103 and a second ink supply 105. The first ink supply 103 contains ink having 20% gel content at room temperature. The second ink supply 105 contains ink having 0% gel content at room temperature. A first pump 107 is connected to the first supply 103. A second pump 109 is connected to the second supply 105.

Ink may flow from the first supply 103 through a first supply line 111. The flowing ink may pass through a one way valve 113 such as a check-valve, needle valve, fuel injector, or other suitable system or device. The ink may pass to a mixing pot 150, which may be heated, and/or configured to heat ink contained by the mixing pot 150.

Ink may flow from the second supply 105 through a second supply line 118. The flowing ink may pass through a one way valve 121 to a mixing pot 150. The ink may be heated by the mixing pot 150. The first pump 107 and/or the second pump 109 may be connected to one or more controllers (not shown) for control of ink flow.

The mixing pot 150 may be a sealed, heated vessel having inputs from communicating with each of the first ink supply 103 and the second ink supply 105. Systems may include further inputs and ink supplies as desired. The mixing pot 150 is preferably sealed to avoid pressurization of the pot as air volume decreases while maintain positive pressure after ink is mixed. The mixing pot 150 may include a stirring system 153 for stirring ink and ensuring blending of two or more different inks. A stirring apparatus 155 may be connected to a motor 157, which may be connected to a controller (not shown).

A feature of known area on a surface of the mixing tank, for example, may be configured to be in operable contact with a pressure sensor. A force or weight addition of each ink component or constituent may be determined by way of the known area and a pressure sensor reading. To maintain pot pressures for operability of the system, various three-way valves 161A-161B and check valves 163 may be implemented. Because an ink reservoir and print head 165 should maintain a negative pressure on ink in during printing and positive pressure while purging, while being vented to the atmosphere during filling, a reservoir control valve 161*c* may be implemented. A fluid delivery line connecting the reservoir and print head 165 and the mixing tank or pot 150 should be a heated path. The reservoir and the print head 165 may be heated, and the mixing pot 150 may be heated.

Control over delivery of desired inks to the mixing pot may be accommodated by open loop and closed loop control methods. For example, in an embodiment, if media has previously been run, a gel concentration setting(s) are called from a storage module or memory, and a printing system configured accordingly. Gel concentrations are determined, ink flow lines purged, and the print head reservoir filled with ink having the gel concentrations determined based on the recalled gel concentration settings. Although purging ink delivery lines is costly and inefficient, methods may be implemented, preferably and by way of example, only each time a new media-type is chosen.

If media settings such as gel concentration setting(s) are not saved, and/or a media type to be used is new to the printing system, a user may input information about the media type. Methods may include determining if media is porous or non-porous. For example, paper may be porous, and plastic may be non-porous. If media is paper, then print results will depend on whether media is coated or uncoated. Uncoated paper is susceptible to showthrough, or bleeding through the paper from a side on which the ink is deposited to an opposite side. The susceptibility is related to a thickness of the paper, which also may be input. An ink having a percentage gel content chosen based on the determined media type and thickness may be generated and used to print a test image. The test image is measured with an image sensor to determine whether the test image exhibits showthrough. If showthrough is acceptable, the test image may be measured to determine if line width and drawback are acceptable, and a gel content of the ink may be adjusted accordingly. Showthrough may not be required to be determined for non-porous media. Test images printed with the adjusted ink(s) may be printed, measured, and the process repeated as necessary to produce an ink having acceptable print image quality characteristics. Gel concentrations that are determined to be optimal for a particular media type may be stored in memory as set points for future print jobs and/or recall.

Figure 2:
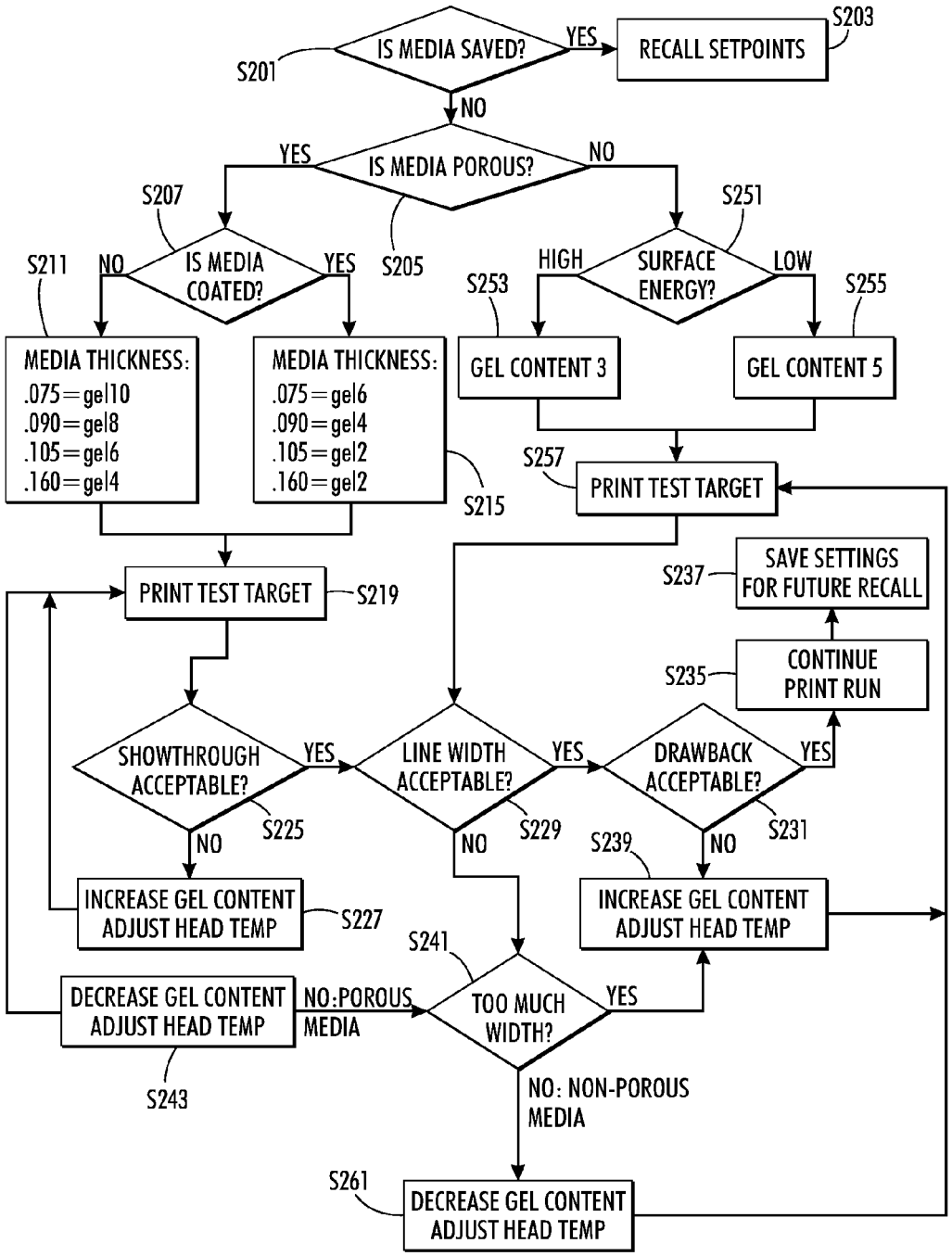
FIG. 2 shows methods of gel ink mixing control in accordance with an exemplary embodiment.

FIG. 2 shows methods of open loop ink gel content control for specific media types in accordance with an exemplary embodiment. A user or sensor system may determine whether a particular media type to be used for a print run is new to the print system. A user or system may determine at S201 whether ink gel content setpoints are saved for the media. If setpoints are saved, the setpoints may be recalled, and the system may be caused to fill the print head reservoir having ink with a gel content that corresponds to the saved setpoints.

If setpoints are not saved, a user or system, such as a connected controller, may determine whether media is porous or non-porous at S205. If the media is porous, such as paper, a user or system may determine at S207 whether the media is coated or uncoated. If the media uncoated, then a gel content may be selected that corresponds with a thickness of the media determined at S211. FIG. 2 shows gel content levels on a zero to ten scale, where 10 corresponds to a 20% gel content. The media thickness is shown in mm. If the media is coated, then a gel content may be selected that corresponds to a thickness of the media determined at S215. A gel content selected may be higher for uncoated paper compared to coated paper, for example.

On a first test print run, the gel content selected at S211 or S215 may be randomly chosen. At S219, a test print image may be produced using ink having the selected gel content, and the test print image may be analyzed by a user to determine whether the image quality is acceptable, and thus whether the ink gel content is suitable for the particular media type. The measurement may be carried out by suitable sensor and measurement systems.

For porous media, showthrough may be measured for acceptability at S225. If showthrough is not acceptable, a gel content of ink may be increased, the print head filled with ink accordingly, and/or the print head temperature may be adjusted at S227. Then, the printing at S219 and determining whether showthrough is acceptable at S225 may be repeated.

If showthrough is acceptable, a line width may be measured for acceptability at S229. If a width of a printed gel ink line deposited on the media is determined to be too small, then, for porous media, a gel content may be decreased, ink produced accordingly, and/or a print head temperature may be adjusted at S243. Then, the printing at S219 and determining whether showthrough is acceptable at S225, and line width is acceptable at S229 may be repeated. Similar, the ink gel content may be decreased, ink produced accordingly, and/or a print head temperature may be adjusted at S261, and a test image printed and analyzed.

If line width is determined to be acceptable at S229, then drawback may be measured for acceptability at S231. If drawback is determined to be unacceptable, then a ink gel content may be increased and/or a print head temperature adjusted at S239, and a test image printed accordingly. If at S231 a drawback of a print image is determined to be acceptable, then a print run may be continued at S235 with ink having the gel content used to produce the print image determined to be acceptable. The settings may be saved corresponding to media type at S237 for future recall. Such methods may be implemented not only for control of ink gel components, but also for other ink components including, for example concentration(s) of photo initiators.

If media is determined to be non-porous at S205, then a surface energy may be determined and/or input at S251. For example, for non-porous media having a high surface energy, a gel content level of 3 may be selected at S253. Alternatively, for non-porous media having a high surface energy, a gel content level of 5 may be selected at S255. A test image may be printed at S257 using ink having the gel content selected at S253 or S255.

On a first test print run, the gel content selected at S253 or S255 may be randomly chosen. At S257, a test print image may be produced using ink having the selected gel content, and the test print image may be analyzed to determine whether the image quality is acceptable, and thus whether the ink gel content is suitable for the particular media type.

The measurement may be carried out by suitable sensor and measurement systems. For example, a test print image may be measured or observed to determine whether line showthrough and/or line width and drawback are acceptable. An indication of the measurement results may be acquired by a controller for determining how to proceed based on the measurements, for example, whether to continue printing and/or save tested ink component settings or adjust gel content and/or a print head temperature and repeat test printing and measuring.

Because showthrough may not be a concern for non-porous media, after a test image is measured, line width may be measured for acceptability at S229, as discussed above. Such methods may be implemented not only for control of ink gel components, but also for other ink components including, for example concentration(s) of photo initiators. Systems may be configured for open loop control using the methods discussed above.

Figure 3:
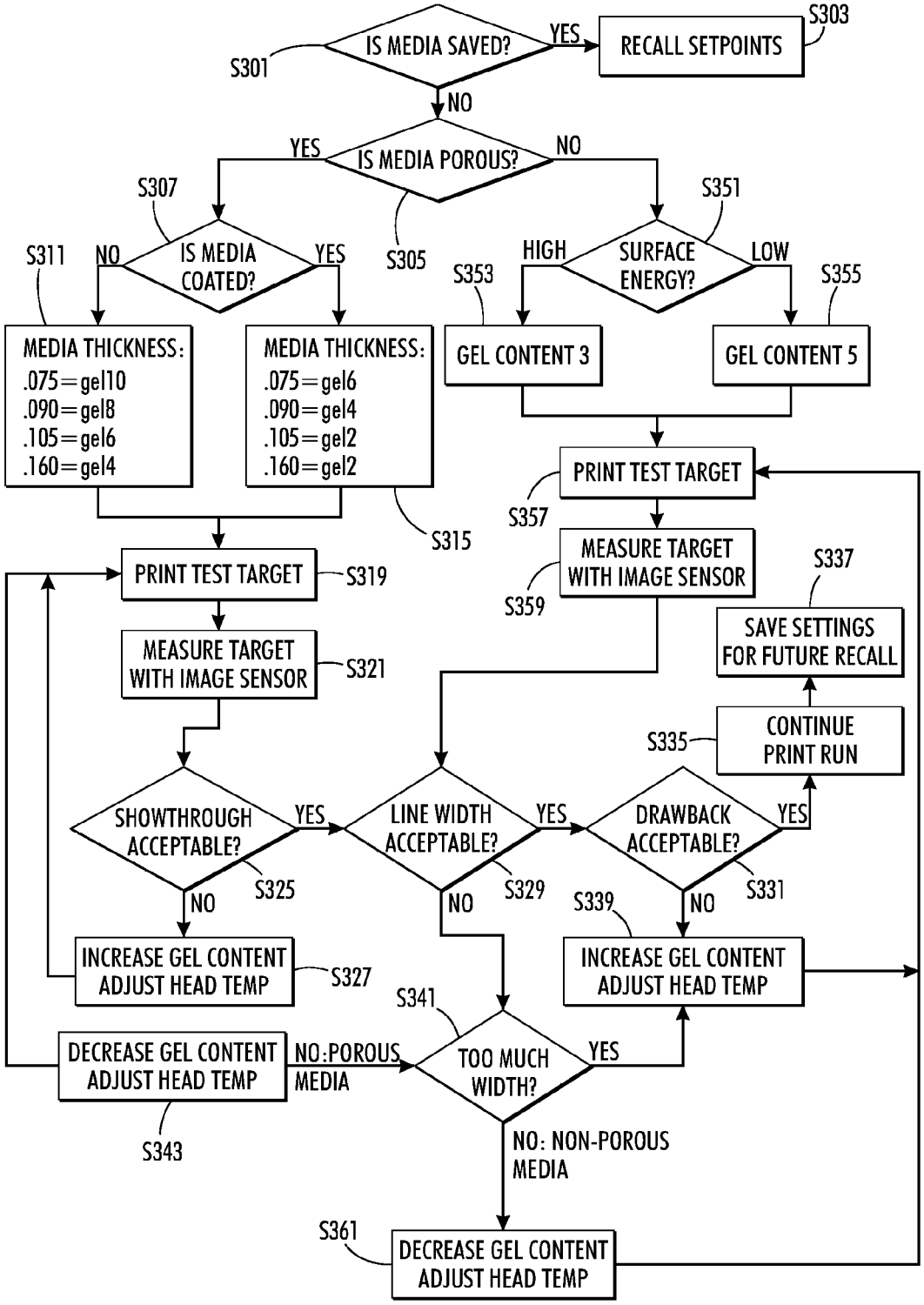
FIG. 3 shows methods of gel ink mixing control in accordance with an exemplary embodiment.

FIG. 3 shows methods of closed loop ink gel content control for specific media types in accordance with an exemplary embodiment. A user or sensor system may determine whether a particular media type to be used for a print run is new to the print system. A user or system may determine at S301 whether ink gel content setpoints are saved for the media. If setpoints are saved, the setpoints may be recalled, and the system may be caused, for example, to fill the print head reservoir having ink with a gel content that corresponds to the saved setpoints.

If setpoints are not saved, a user or system, such as a system including a connected controller, may determine whether media is porous or non-porous at S305. If the media is porous, such as paper, a user or system may determine at S307 whether the media is coated or uncoated. If the media uncoated, then a gel content may be selected that corresponds with a thickness of the media determined at S311. FIG. 3 shows gel content levels on a zero to ten scaled, where 10 corresponds to a 20% gel content. The media thickness is shown in mm. If the media is coated, then a gel content may be selected that corresponds to a thickness of the media determined at S315. A gel content selected may be higher for uncoated paper compared to coated paper, for example.

On a first test print run, the gel content selected at S311 or S315 may be randomly chosen. At S319, a test print image may be produced using ink having the selected gel content, and the test print image may be analyzed by, for example, a sensor system to determine whether the image quality is acceptable, and thus whether the ink gel content is suitable for the particular media type.

The measurement may be carried out by suitable sensor and measurement systems. For example, at S321, a test print image may be measured with an image sensor. An image sensor may be configured for detecting and/or measuring showthrough, line width, and/or drawback, and may be connected to a controller for determining how to proceed based on measurements, for example, whether to continue printing and/or save tested ink component settings or adjust gel content and/or a print head temperature and repeat test printing and measuring.

For porous media, showthrough may be measured for acceptability at S325. If showthrough is not acceptable, a gel content of ink may be increased, the print head filled with ink accordingly, and/or the print head temperature may be adjusted at S327. Then, the printing at S319 and determining whether showthrough is acceptable at S325 may be repeated.

If showthrough is acceptable, a line width may be measured for acceptability at S329. If a line width, or a width or a printed gel ink line deposited on the media is determined to be too small, then, for porous media, a gel content may be decreased, ink produced accordingly, and/or a print head temperature may be adjusted at S343. Then, the printing at S319 and determining whether showthrough is acceptable at S325, and line width is acceptable at S329 may be repeated. Similar, the ink gel content may be decreased, ink produced accordingly, and/or a print head temperature may be adjusted at S361, and a test image printed and analyzed.

If line width is determined to be acceptable at S329, then drawback may be measured for acceptability at S331. If drawback is determined to be unacceptable, then a ink gel content may be increased and/or a print head temperature adjusted at S339, and a test image printed accordingly. If at S331 a drawback of a print image is determined to be acceptable, then a print run may be continued at S335 with ink having the gel content used to produce the print image determined to be acceptable. The settings may be saved corresponding to media type at S337 for future recall. The concentrations components may be monitored, tracked, and stored. For an ink having an ink gel content that is determined to be acceptable, the respective ink component concentrations may be saved. The saved ratios may be retrieved as required for printing, and adjusted as necessary for particular printing conditions. For example, if a mixing pot contains an ink having only a first ink component, and it is determined that media for a print job requires ink having both a first ink component and a second ink component in a particular ratio that is stored, then the second ink component may be added to the mixing pot until the particular ratio is reached. Similarly, the first ink component may be added to the mixing pot as necessary.

If media is determined to be non-porous at S305, then a surface energy may be determined and/or input at S351. For example, for non-porous media having a high surface energy, a gel content level of 3 may be selected at S353. Alternatively, for non-porous media having a high surface energy, a gel content level of 5 may be selected at S355. A test image may be printed at S357 using ink having the gel content selected at S353 or S355.

On a first test print run, the gel content selected at S353 or S355 may be randomly chosen. At S357, a test print image may be produced using ink having the selected gel content, and the test print image may be analyzed to determine whether the image quality is acceptable, and thus whether the ink gel content is suitable for the particular media type.

The measurement may be carried out by suitable sensor and measurement systems. For example, at S359, a test print image may be measured with an image sensor. An image sensor may be configured for detecting and/or measuring showthrough, line width, and/or drawback, and may be connected to a controller for determining how to proceed based on measurements, for example, whether to continue printing and/or save tested ink component settings or adjust gel content and/or a print head temperature and repeat test printing and measuring. Because showthrough may not be a concern for non-porous media, after a test image is measured using a sensor at S359, which may include one or more in-line sensors, such as a full width image content sensor, line width may be measured for acceptability at S329, as discussed above.

Systems may be configured for mixing gel inks in line using flow measurement methods for determining ink component additions. Methods of mixing gel inks in line in accordance with, for example, the above-discussed control methods may include using flow measurement to deliver ink in desired concentrations. For example, to quickly change a gel content of ink in print head(s) depending on printing conditions and media being used, systems may be configured to mix a high gel content ink with low gel content ink or ink containing no gel in select ratios to obtain a desired gel ink content using flow measurement methods. In systems configured for flow measurement-enabled in line mixing of gel inks, supply delivery lines are heated to maintain a desired or suitable ink viscosity to enable flow meter monitoring. Two or more components of ink may be mixed by delivering the components by way of the heated ink supply lines to a mixing pot. Flow meters may be implemented for determining a flow rate of each heated component added to the mixing pot. The flow meters may be used to measure mass addition of ink delivered from supply lines to the mixing pot, the measurements being based on a known fluid density, flow meter area, and flow rate. Flow meters may be implemented in line in fluid supply lines at point(s) interposing an ink supply and the mixing pot.

Figure 4:
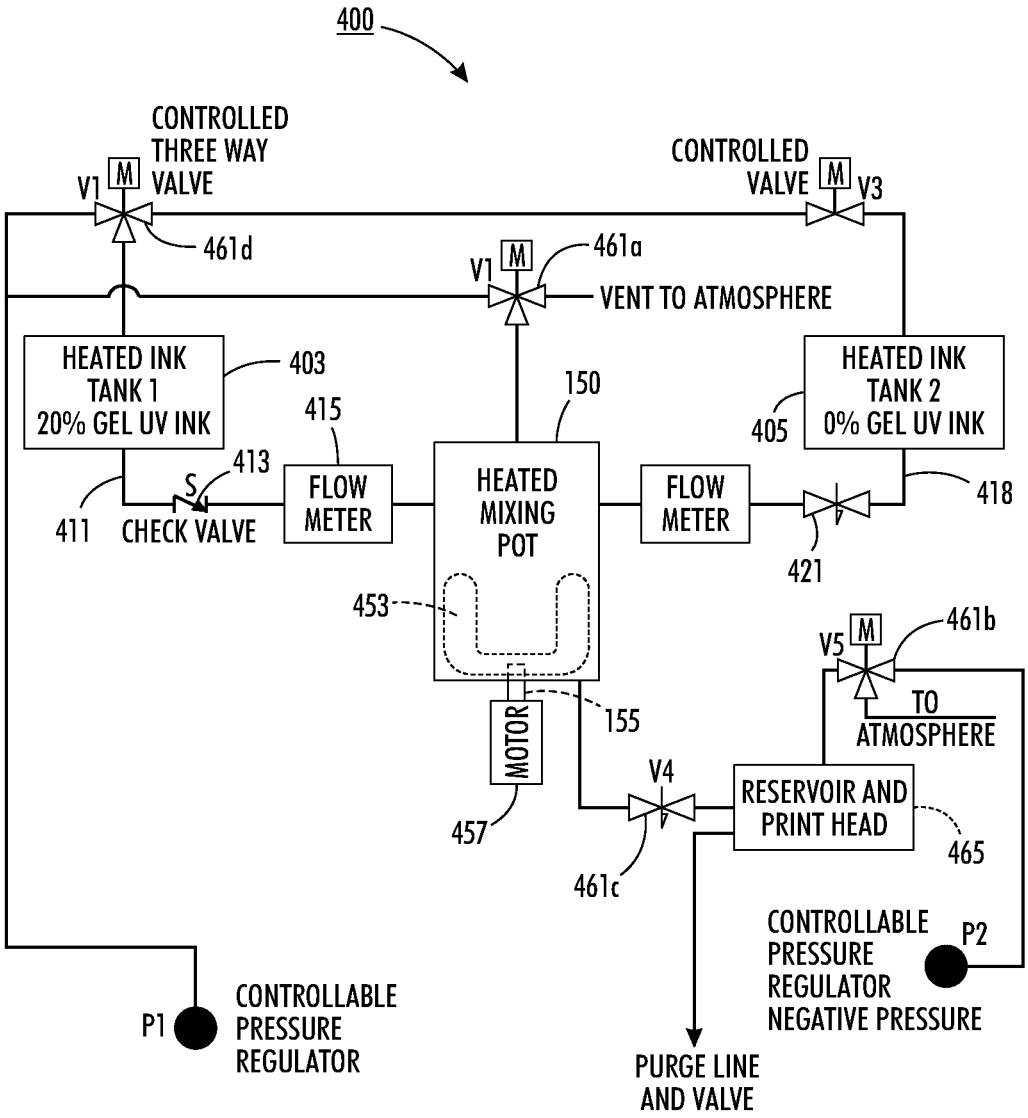
FIG. 4 shows a diagrammatic view of an in-line gel ink mixing system configured for flow measurement-based in line gel ink mixing in accordance with an exemplary embodiment.

FIG. 4 shows a diagrammatic view of an exemplary in-line gel ink mixing system configured for flow measurement-based in line gel ink mixing. In particular, FIG. 4 shows a system having a first ink supply 403 and a second ink supply 405. The first ink supply 103 contains ink having 20% gel content at room temperature. The second ink supply 405 contains ink having 0% gel content at room temperature. The first ink supply 403 and the second ink supply 405 are heated.

Ink may flow from the first supply 403 through a first supply line 411. The flowing ink may pass through a one way valve 413 such as a check-valve, needle valve, fuel injector, or other suitable system or device, and through a flow meter 415. The flow meter 415 may be implemented for measuring an amount of fluid, or ink, passing through the meter at a given time. A mass of ink to be delivered from the first supply 403 may be calculated based on a known density of the ink, a known area of the flow meter, and a known time period of ink flow. The flow meter 415 may comprise any suitable flow meter for measuring a flow of fluid such as vane-type flow meters, turbine-type flow meters, ultrasonic, pressure drop, and other suitable flow meter designs.

The ink supply 403 and ink delivery line 411 may be heated to maintain a viscosity of ink passing through the delivery line 411 for operable implementation of the flow meter 415. The ink may pass to a mixing pot 450, which may be heated, and/or configured to heat ink contained by the mixing pot 450. The flow meter 415 may be used to determine an amount of ink delivered to the mixing pot 450 from the first ink supply 403.

Ink may flow from the second supply 405 through a second supply line 418. The flowing ink may pass through a one way valve 421 to a flow meter 419. The flow meter 419 may be implemented for measuring an amount of fluid, or ink, passing through the meter at a given time. A mass of ink to be delivered from the first supply 403 may be calculated based on a known density of the ink, a known area of the flow meter, and a known time period of ink flow. The flow meter 415 may comprise any suitable flow meter for measuring a flow of fluid such as vane-type flow meters, turbine-type flow meters, ultrasonic, pressure drop, and other suitable flow meter designs.

The ink supply 405 and ink delivery line 418 may be heated to maintain a viscosity of ink passing through the delivery line 418 for operable implementation of the flow meter 419. After passing through the flow meter 419, the ink may be caused to pass to the mixing pot 450. The ink may be heated by the mixing pot 450. The first ink supply 403 and/or the second ink supply 407 may be connected to one or more controllers (not shown) for control of ink flow.

The mixing pot 450 may be a sealed, heated vessel having inputs from communicating with each of the first ink supply 403 and the second ink supply 405 by way of the delivery lines 411 and 418, respectively. Systems may include further inputs and ink supplies as desired. The mixing pot 450 is preferably sealed to avoid pressurization of the pot as air volume decreases while maintain positive pressure after ink is mixed. The mixing pot 450 may include a stirring system 453 for stirring ink and ensuring blending of two or more different inks. A stirring apparatus 455 may be connected to a motor 457, which may be connected to a controller (not shown).

A feature of known area on a surface of the mixing tank, for example, may be configured to be in operable contact with a pressure sensor. A force or weight addition of each ink component or constituent may be determined by way of the known area and a pressure sensor reading. To maintain pot pressures for operability of the system, various three-way valves 461*a*-461*d* and check valves 463 may be implemented. Because an ink reservoir and print head 465 should maintain a negative pressure on ink during printing and positive pressure while purging, while being vented to the atmosphere during filling, a reservoir control valve 461 c may be implemented. A fluid delivery line connecting the reservoir and print head 465 and the mixing tank or pot 450 should be a heated path. The reservoir and the print head 465 may be heated, and the mixing pot 450 may be heated.

One or more of the system components shown in FIG. 4 may be controlled for mixing gel ink as desired for delivery to a print head and/or print head reservoir. For example, one or more system components shown in FIG. 4 may be connected to a controller that may be caused to control the system based on computer readable instructions based on user input and/or stored in a memory module. Methods of in line gel ink mixing may be implemented, for example, for carrying out closed loop or open loop control as disclosed herein.

Figure 5:
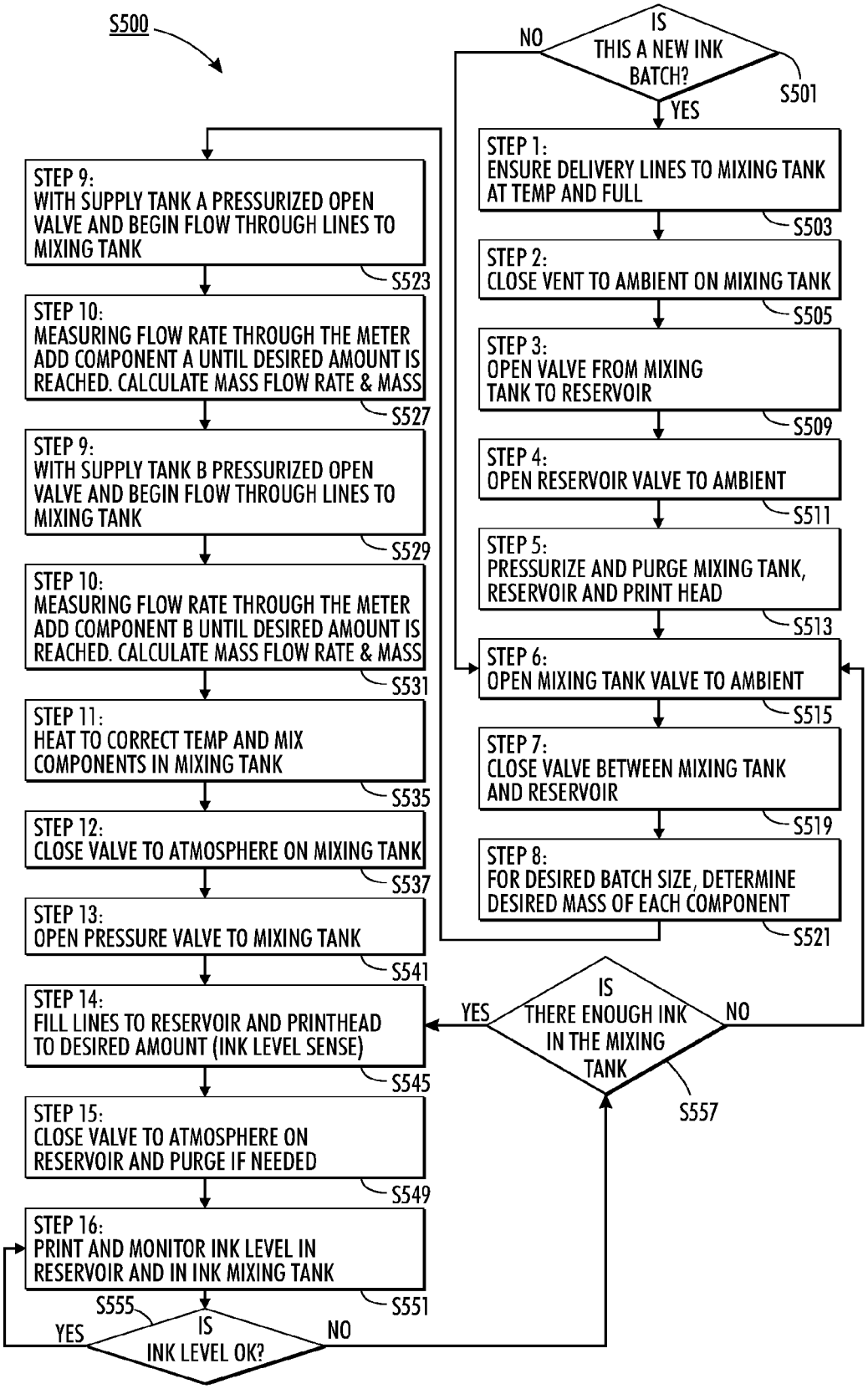
FIG. 5 shows in line ink mixing methods in accordance with an exemplary embodiment using flow measurement.

FIG. 5 shows methods of in line ink mixing using a system configured for flow measurement as shown in FIG. 4. In particular, FIG. 5 shows an in-line mixing process 500. Methods may include determining at S501 whether a new ink batch is to be produced. If so, methods may include ensuring that ink delivery lines connecting one or more ink supplies and a mixing pot are full and sufficiently heated at S503. The ink may be heated to maintain a viscosity suitable for flow measurement using flow meters. A vent to ambient connected to the mixing pot may be closed at S505. A valve may be actuated for opening a pathway between the mixing pot and an ink reservoir at S509. At S511, a vent to ambient connected to the ink reservoir may be opened. The mixing tank, ink reservoir, and print head may be purged at S513.

After S513, or after S501 if a new ink batch is not being produced, a vent to ambient connected to the mixing pot may be opened at S515. A valve may be actuated for closing the pathway between the mixing pot and the ink reservoir at S519. For a desired batch size, a desired mass for each ink component to be mixed is input, recalled, received, or otherwise determined at S521.

A first ink supply or supply tank connected to the mixing pot by a first ink supply line may be pressurized. A valve may be actuated for opening the pathway, and ink may be caused to flow from the ink supply to the mixing pot at S523. A flow meter disposed in the first ink supply line may be used to measure flow of ink passing through the supply line to the mixing pot at S527. In particular, a flow meter may be configured to sense flow of ink to provide flow rate data. Accordingly, a mass flow rate and a mass of ink added to the mixing pot may be determined, and ink from the first ink supply may be added until a desired amount of the ink from the first supply is contained by the mixing pot.

A second ink supply or supply tank connected to the mixing pot by a second ink supply line may be pressurized. A valve may be actuated for opening the pathway, and ink may be caused to flow from the second ink supply to the mixing pot at S529. A flow meter disposed in the second ink supply line may be used to measure flow of ink passing through the supply line to the mixing pot at S531. In particular, a flow meter may be configured to sense flow of ink to provide flow rate data. Accordingly, a mass flow rate and a mass of ink added to the mixing pot may be determined, and ink from the second ink supply may be added until a desired amount of the ink from the second supply is contained by the mixing pot.

The mixing pot may be heated. At S535, a temperature of the mixing pot may be adjusted and the components mixed in the mixing tank. For example, ink delivered from a first ink supply and ink delivered from a second ink supply may be advantageously mixed at a predetermined mixing pot temperature. The mixing pot may be, for example, heated to such a temperature at S535, and a stirring system may be configured to stir the ink at the predetermined temperature that is advantageous for mixing.

A S537, a valve connecting the mixing tank to atmosphere may be closed. A S541, a pressure valve connected to the mixing tank may be opened. At S545, delivery lines connecting the mixing tank to an ink reservoir and print head may be filled to a desired level. A valve connecting the ink reservoir and/or print head may be closed at S549, and the system may be purged if needed.

Ink may be delivered from the print head to a substrate by printing at S551, wherein an ink level, or a volume or amount of ink contained by the ink reservoir may be monitored. Based on the monitoring at S551, it may be determined by an operator or sensor-connected controller whether an amount of ink remaining in the print head and/or reservoir is at a desired level at S555. The desired level of ink may be a predetermined amount that is stored in system memory, for example. If the determined ink level is equal to a target value or within a target range that corresponds to the desired ink level, then processing may proceed to S551 for further printing. If the determined ink level is outside of a target range or does not match a target value that corresponds to a desired ink level, then an ink level of the mixing pot may be determined at S557. If the level of ink in the mixing pot is determined at S557 to be outside of a target range, or does not equal a target value, then processing may proceed to S515 to add further ink components to the mixing pot for mixing to produce ink having a desired gel content. If the level of ink in the mixing pot is determined at S557 to equal a target value or is within a target range of values, then processing may proceed to S545 for delivering the ink to the print head and/or reservoir.

Gel inks are advantageous over solid inks at least because flowability of gel inks allows for delivery at room temperature using suitable pumping techniques. Inks having little or no gel content may be pumped and passed through delivery lines from one location to another at room temperature and under high pressure. Due to a lower viscosity of inks having little or no gel content, peristaltic pumps, diaphragm pumps, and flow meters may be operably implemented for pumping ink and monitoring flow for determining and/or controlling addition of particular ink components to a mixing pot. Inks having higher gel content, however, may become entrained with air during pumping causing inconsistency ink density. Further, flow meters that are suitable for less viscous fluids such as inks having a lower gel content may not be suitable for monitoring flow of viscous inks having a higher gel content and a grease-like consistency. Mass addition may be measured to overcome difficulties associated with inconsistent density and measuring flow of inks having a higher gel content.

Figure 6:
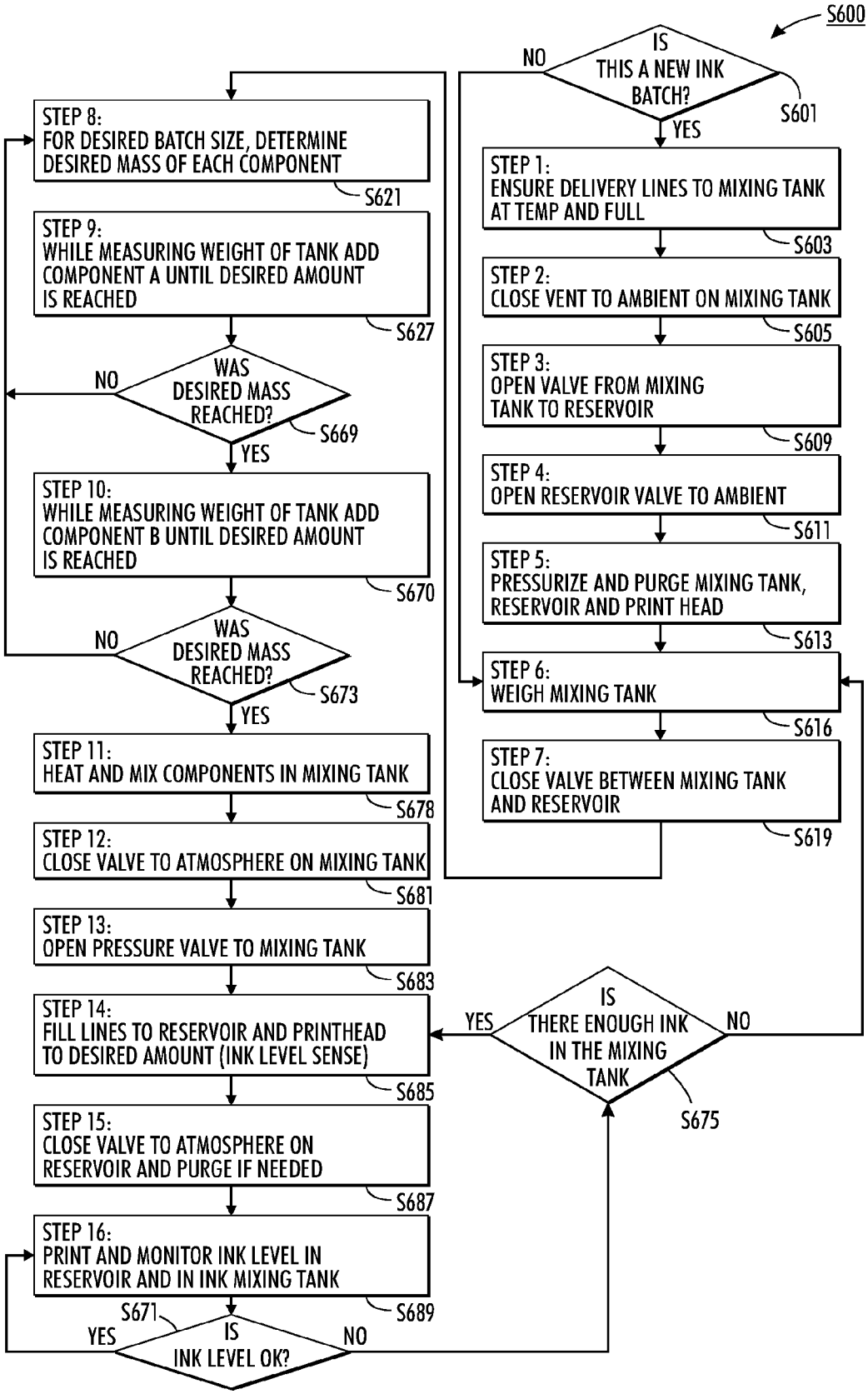
FIG. 6 shows in line ink mixing methods in accordance with an exemplary embodiment using mass measurement.

FIG. 6 shows methods of in line ink mixing using a system configured for mass measurement as shown in FIG. 1, for example. FIG. 6 shows mass measurement process 600, which may begin with determining whether an ink batch is a new ink batch. The delivery lines to a mixing pot of the in-line ink mixing system, the mixing pot, delivery lines from the mixing pot to an ink reservoir and print head, and the ink reservoir and print head may be heated. If an ink batch is a new ink batch, methods may include ensuring that delivery lines to the mixing pot are at a predetermined or desired temperature and/or that the delivery lines are full. At S605, a vent to ambient connected to the mixing tank is opened. At S609, a valve may be opened to enable flow of ink from the mixing pot to the reservoir. A valve from the mixing pot to ambient may then be opened at S611. The mixing pot, reservoir, and print head may be may be pressurized and purged at S613. Then, the mixing tank may be weighed at S616. If the ink batch is not a new ink batch, then the process may proceed from S601 to S616.

At S619, the valve between the mixing pot and the ink reservoir may be closed. A desired mass of each component to be added to the mixing pot for a desired ink batch size may be determined at S621.

Methods may be include delivering a first ink component from a first ink supply to the mixing pot, while measuring the weight of the mixing pot, until a desired amount of the first ink is contained by the mixing pot at S627. Methods may include determining at S669 whether a desired mass of the first ink component has been added to the mixing tank. For example, a determined mass of the first ink component contained by the mixing pot may be compared with a predetermined or desired mass. If the desired mass has not been reached, then methods may include proceeding through S621-S669 as required to reach a desired mass of ink contained by the mixing pot. If the desired mass has been reach, then a second ink component may be delivered to the mixing pot, while measuring the weight of the mixing pot at S670 until a desired amount of the second ink component has been added to the mixing pot. Methods may include determining at S673 whether a desired mass of the first ink component has been added to the mixing tank. For example, a determined mass of the first ink component contained by the mixing pot may be compared with a predetermined or desired mass. If the desired mass has not been reached, then methods may include proceeding through S621-S673 as required to reach a desired mass of ink contained by the mixing pot. Methods may include adding more than two ink components to the mixing pot and carrying out process corresponding to S621-S667 for each such ink component.

If at S673 it has been determined that desired mass of the second ink component has been added to the mixing pot, then the ink components may be heated and mixed in the mixing pot at S678. The mixing pot may include a stirrer or similar device suitable for mixing gel ink. A valve to atmosphere on the mixing pot may be closed at S681. A pressure valve connected to the mixing tank may be opened at S683. At S685, the ink reservoir, print head and ink delivery lines connecting the reservoir and the mixing pot may be filled with mixed ink. At S687, a valve to atmosphere on the reservoir may be closed, and the reservoir may be purged if necessary. Printing may be carried out at S689 while monitoring a level of ink in the ink reservoir. The ink may be monitored using a suitable sensor system, for example.

Methods may include determining whether a ink level is within a desired range of values or equal to a desired value at S671. If the ink level is within the desired range, then printing may continue at S689. If the ink level is not within the desired range or does not equal a desired or predetermined value, then S616-S671 may be repeated as necessary. For example, methods include determining whether the mixing pot contains enough ink to replenish the ink reservoir at S675. If so, then S685 through S671 may be repeated. If the mixing pot does not contain enough ink to replenish the reservoir as desired, then S616-S671 may be repeated as necessary.

Such methods may be implemented not only for control of ink gel components, but also for other ink components including, for example concentration(s) of photo initiators. Systems for implementing methods may include a sensor system, controller, and computer readable medium on which is recorded methods including those discussed above for accommodating ink component control for particular media types.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable processing means by which to carry into effect the disclosed media-specific ink content control systems and methods for familiarity and ease of understanding. Although not required, elements of the disclosed exemplary embodiments may be provided, at least in part, in a form of hardware circuits, firmware, or software computer-executable instructions to carry out the specific functions described. These may include individual program modules executed by one or more processors. Generally, program modules include routine programs, objects, components, data structures, and the like that perform particular tasks, or implement particular data types, in support of the overall objective of the systems and methods according to this disclosure.

Those skilled in the art will appreciate that other embodiments of the disclosed subject matter may be practiced with many types of image forming devices, or combinations of image forming devices in many different configurations. Embodiments according to this disclosure may be practiced, for example, in network environments, where processing and control tasks may be performed according to instructions input at a user's workstation and/or according to predetermined schemes that may be stored in data storage devices and executed by particular image forming devices or combinations of image forming devices.

As indicated above, embodiments within the scope of this disclosure may also include computer-readable media having stored computer-executable instructions or data structures that can be accessed, read and executed by one or more processors, for example, in one or more image forming devices. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or via another communications connection, whether wired, wireless, or in some combination of the two, the receiving processor properly views the connection as a computer-readable medium. Combinations of the above should also be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents examples of a corresponding sequence of acts for implementing the functions described in the steps. The exemplary depicted steps may be executed in any reasonable order to effect the objectives of the disclosed embodiments. No particular order to the disclosed steps of the method is necessarily implied by the figures and the accompanying description, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure. For example, the principles of the disclosure may be applied to each individual image forming device of a plurality of image forming devices, widely deployed and connected to any number of communications interfaces. In such instances, each image forming device may include some portion of the disclosed system and execute some portion of the disclosed method.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for media-specific ink content control for delivering ink having a selected gel component concentration to a print head for printing on a specific media type, the method comprising:

obtaining, with a controller, a specific media type to be printed with ink;

analyzing, with the controller, at least one physical characteristic of the obtained specific media type;

controlling, with the controller, a flow of a first gel ink component from a first gel ink component source to provide a first proportional amount of the first gel ink component to a mixing and heating reservoir, the first gel ink component having a first gel ink component concentration;

controlling, with the controller, a flow of a second gel ink component from a second gel ink component source to provide a second proportional amount of the second gel ink component to the mixing and heating reservoir, the second gel ink component having a second gel ink component concentration different from the first gel ink component concentration, the first proportional amount of the first gel ink component and the second proportional amount of the second gel ink component being controlled based on the analyzed at least one physical characteristic of the obtained specific media type;

physically agitating the first proportional amount of the first gel ink component and the second proportional amount of the second gel ink component with a mixing structure in the mixing and heating reservoir to obtain an ink having a preliminary test gel component concentration;

heating the ink having the preliminary test gel component concentration to a first pre-determined delivery temperature in the mixing and heating reservoir;

supplying the heated ink having the preliminary test gel component concentration to an inkjet print head;

jetting the ink having the preliminary test gel component concentration from the inkjet print head onto an image receiving media substrate of the specific media type to print a test image;

evaluating, with a sensor, at least one image quality component of the test image on the image receiving media substrate;

adjusting at least one of the first proportional amount of the first gel ink component, the second proportional amount of the second gel ink component and the first pre-determined delivery temperature to obtain an ink having a final specific gel component concentration; and using the ink having the final specific gel component concentration to print digital images via the inkjet print head on a plurality of image receiving media substrates of the specific media type.

2. The method of claim 1, the analyzing, with the controller, the at least one physical characteristic of the obtained specific media type comprising determining whether the selected media type is porous or non-porous.

3. The method of claim 2, the analyzing, with the controller, the at least one physical characteristic of the obtained specific media type further comprising determining whether the selected media type is coated or non-coated if the selected media type is porous.

4. The method of claim 2, the analyzing, with the controller, the at least one physical characteristic of the obtained specific media type further comprising determining a surface energy of the selected media type if the selected media type is non-porous.

5. The method of claim 1, the analyzing, with the controller, the at least one physical characteristic of the obtained specific media type comprising determining a thickness of the specific media type.

6. The method of claim 1, the evaluating, with the sensor, the at least one image quality component of the test image on the image receiving media substrate comprising determining whether showthrough of the test print image is at an acceptable level.

7. The method of claim 1, the evaluating, with the sensor, the at least one image quality component of the test image on the image receiving media substrate comprising determining whether line width is acceptable.

8. The method of claim 1, the evaluating, with the sensor, the at least one image quality component of the test image on the image receiving media substrate comprising determining whether a drawback is at an acceptable level.

9. The method of claim 1, further comprising storing the selected gel component concentration corresponding to the specific media type as a set of set points for the specific media type.

10. An ink content control system for controlling media-specific ink content in accordance with a specific media type, comprising:

a first gel ink component source holding a first gel ink component having a first gel ink component concentration;

a second gel ink component source holding a second gel ink component having a second gel ink component concentration different from the first gel ink component concentration;

an ink mixing and heating reservoir configured to (1) physically agitate proportional amounts of the first gel ink component and the second gel ink component with a mixing structure to obtain an ink having a particular gel component concentration, (2) heat the ink having the particular gel component concentration to a pre-determined delivery temperature, and (3) deliver the heated ink having the particular gel concentration to an inkjet print head; and at least one controller programmed to obtain a specific media type to be printed with ink;

analyze at least one physical characteristic of the obtained specific media type;

control a flow of the first gel ink component from the first gel ink component source to provide a first proportional amount of the first gel ink component to the mixing and heating reservoir;

control a flow of the second gel ink component from the second gel ink component source to provide a second proportional amount of the second gel ink component to the mixing and heating reservoir, the first proportional amount of the first gel ink component and the second proportional amount of the second gel ink component being controlled based on the analyzed at least one physical characteristic of the obtained specific media type;

control the physically agitating and the heating the ink in the mixing and heating reservoir;

control supplying the heated ink to an inkjet print head and jetting the ink from the inkjet print head onto an image receiving media substrate of the specific media type to print a test image;

receive sensor information regarding at least one observed image quality component in the printed test image;

evaluate the at least one observed image quality component of the test image;

adjust at least one of the first proportional amount of the first gel ink component, the second proportional amount of the second gel ink component and the first pre-determined delivery temperature to obtain an ink having a final specific gel component concentration; and direct imaging operations using the ink having the final specific gel component concentration via the inkjet print head to form a plurality of images on a plurality of image receiving media substrates of the specific media type.

11. The method of claim 10, the first proportional amount of the first gel ink component being measured by a first flow sensor and the second proportional amount of the second gel ink component being measured by a second flow sensor.

12. The method of claim 10, the controller being further programmed to weigh the mixing and heating reservoir to determine a first mixer weight;

control delivery of the first gel ink component to the mixing and heating reservoir until a second mixer weight is reached; and control delivery of the second gel ink component to the mixing and heating reservoir until a third mixer weight is reached.

* * * * *